US006056607A

United States Patent [19]

Huang et al.

[11] Patent Number: 6,056,607

[45] Date of Patent: May 2, 2000

[54] MANUALLY DRIVEN FITNESS DEVICE FOR EXERCISE ON WATER SURFACE

[76] Inventors: Chen-Chi Huang, No. 13, 197 Lane, Chung Hsing Rd, Yang Mei Town, Taoyuan County, Taiwan, 326; Swan-Chiu Huang, No. 53-2, Chien-Kuo Village, Youg Kong City, Tainan County, Taiwan, 710

[21] Appl. No.: 09/287,964

[22] Filed: Apr. 9, 1999

[51] Int. Cl.[7] ..... B63H 16/18

[52] U.S. Cl. ..... 440/30

[58] Field of Search ..... 440/21, 26–31

[56] References Cited

U.S. PATENT DOCUMENTS

| | | | |
|---|---|---|---|
| 1,005,478 | 10/1911 | Sandberg | 440/31 |
| 1,072,027 | 9/1913 | Mosteller | 440/29 |
| 1,342,619 | 6/1920 | Bechtel | 440/31 |
| 1,728,103 | 9/1929 | Chaligne | 440/31 |

*Primary Examiner*—Jesus D. Sotelo

*Attorney, Agent, or Firm*—Raymond Y. Chan; David and Raymond

[57] ABSTRACT

A manually driven fitness device includes a main body, two floating barrels respectively mounted on both sides of the main body, a front drive mounted at the front end of the main body, a rear drive speed variation device mounted at the rear end of the main body, a power transmitting device connected with the front drive and the rear drive speed variation device, and a power output device engaged with the output end of the rear drive speed variation device. The floating barrel is a hollow object, which supports the main body to float in water with its buoyancy, while the user may exert force with one's hands and feet respectively on the front power drive and the rear drive speed variation device, and stretch arms and legs in a regular pattern so as to achieve the effects of exercise on water surface or in the water.

4 Claims, 10 Drawing Sheets

MANUALLY DRIVEN FITNESS DEVICE FOR EXERCISE ON WATER SURFACE

BACKGROUND OF THE PRESENT INVENTION

The present invention relates to fitness equipment, and more particularly to a special fitness device, which can be used simultaneously on water surface or in the water, and driven by the force exerted by the user with one's hands and feet, enabling the users to achieve the purpose of exercise and fitness.

Swimming is one of the best way to exercise, during which every part of the human body is in motion, and every joint and spine are not subject to pressure since the weight of the entire body is supported by the buoyancy of water. Meanwhile, the effects of the exercise are greatly enhanced by simultaneously moving arms and legs. However, quite a few people have given up such a best way to exercise because they are unable to swim or are not good at swimming.

SUMMARY OF THE PRESENT INVENTION

A main object of the present invention is to provide a manually driven fitness device adapted for floating on water surface, partly immersing in water and being driven by the user's hands and feet when in use, and thus allowing the user to choose whether to move forward or stay still and to stretch one's arms and legs to the maximum extent so as to achieve the same best effects as in swimming because it Another object of the present invention is to provide a manually driven fitness device, which can not only bring about excellent effects of fitness, but also minimize the bodily fatigue and injury during the exercise because the weight of human body is supported by the buoyancy of water and the fitness device so that the user does not need to bear any additional weight.

Another object of the present invention is to provide a manually driven fitness device, which allows the user to make the most suitable adjustment according to one's body size, and to use it under the most comfortable conditions so that the user would not feel tired even after a long time of exercise.

Another object of the present invention is to provide a manually driven fitness device, which is extremely safe to use and would not be overturned even in the water of high waves because the floating barrels of the main body are always floating on water surface when in use. Therefore, the present invention can be used as exercise equipment for people, who are unable to swim or are not good at swimming, to learn swimming or get used to water.

Figure 1:
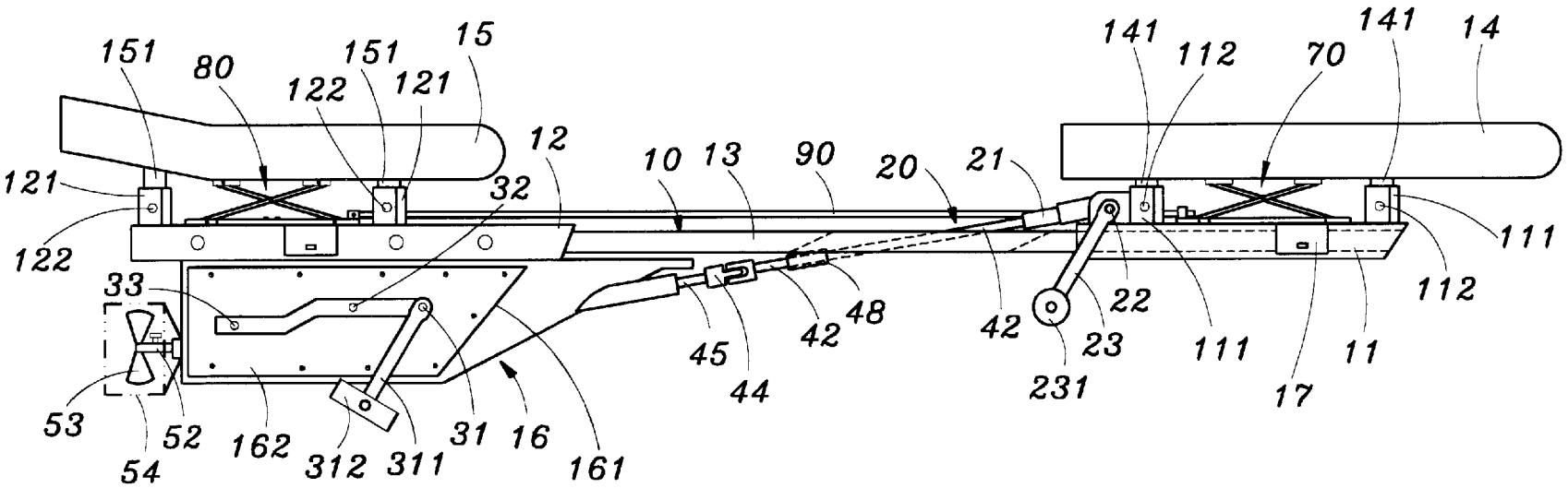
FIG. 1 is a front view of a manually driven fitness device according to a preferred embodiment of the present invention.

| | | | | | |
|---|---|---|---|---|---|
| 10 | main body | 11 | front sleeve | 111, 121 | hollow pole |
| 112, 122 | drain hole | 113, 123 | embed slot | 114 | opening |
| 12 | rear sleeve | 13 | supporting stand | 131 | groove |
| 14 | front floating barrel | 141, 151 | floating pole | 142, 152 | embed flange |
| 15 | rear floating barrel | 16 | hollow casing | 161 | opening |
| 162 | cover | 17 | outer cover | 171 | protruded bar |
| 20 | front drive | 21 | T-shape sleeve | 22 | the first mandrel |
| 23, 311 | crank | 231 | handle | 30 | rear drive speed variation device |
| 31 | the second mandrel | 312 | paddle | 32 | the third mandrel |
| 33 | the fourth mandrel | 34 | the first driving chain wheel | 35 | the first driven chain wheel |
| 36 | the second driving | 37, 39 | chain | 38 | the second driven chain |

-continued

| | | | | | |
|---|---|---|---|---|---|
| | chain wheel | | | | wheel |
| 40 | power transmission device | 41 | driving bevel gear | 42 | the first transmitting shaft |
| 43 | driven bevel gear | 44 | universal coupling | 45 | the second transmitting shaft |
| 46 | driving bevel gear | 47 | driven bevel gear | 471 | cylindrical ring |
| 472 | pawl | 473 | pre-pressed spring | 51 | worm gear |
| 481 | screw hole | 50 | power output device | 53 | propeller |
| 52 | output shaft | 521 | worm | 49 | ratchet |
| 54 | flow build-up barrel | 541 | opening | 72, 82 | rack |
| 70 | front height adjusting device | 71, 81 | guide rail | 75, 85 | connecting bar set |
| 73, 83 | pinion | 74, 84 | slide chute | 90 | connecting rods |
| 80 | rear height adjusting device | 851 | sliding element | 921 | through hole |
| 90 | positioning hole | 92 | fixing block | | |
| A | pin | B | fixing bolt | | |

DETAILED DESCRIPTION OF THE PREFERRED EMBODIMENT

Referring FIGS. 1 to 9 of the drawings, a manually driven fitness device for exercise on water surface according to a preferred embodiment of the present invention is illustrated, which comprises a main body 10, a front drive 20 firmly affixed at the front end of the main body 10, a rear drive speed variation device 30 firmly affixed at the rear end of the main body 10, a power transmitting device 40 connected between the front drive 20 and the rear drive speed variation device 30, and a power output device 50.

Figure 2:
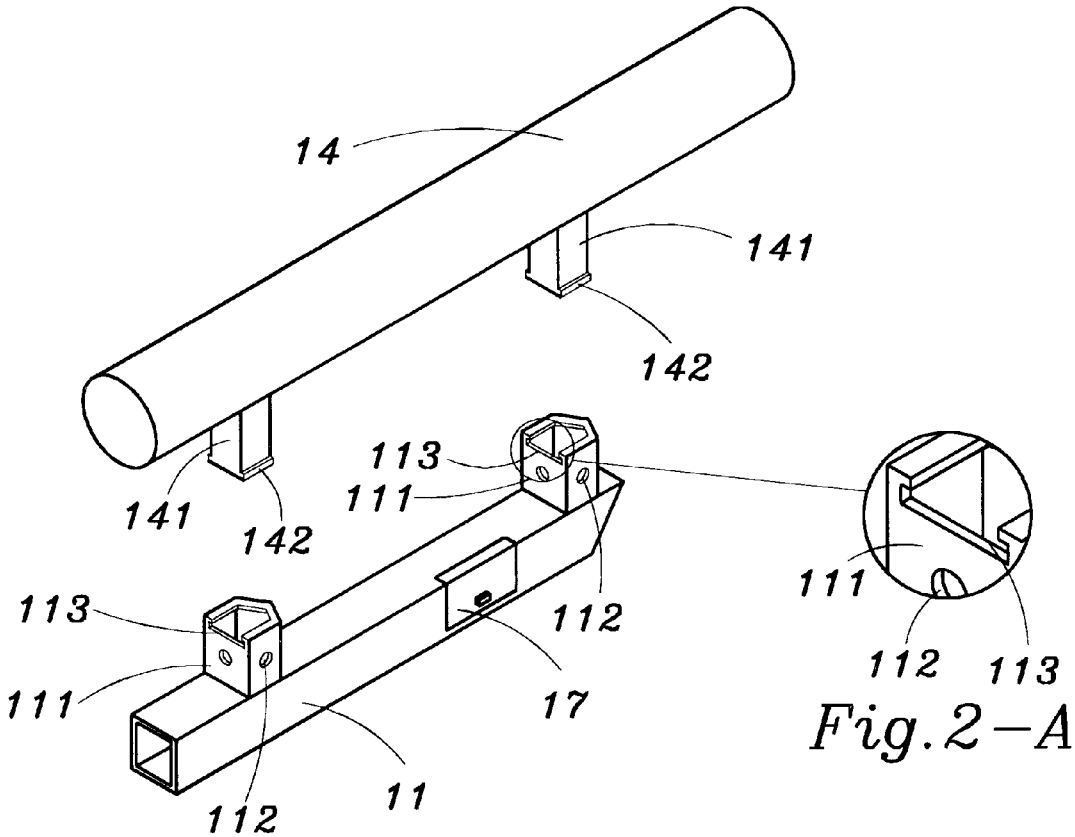
FIG. 2 is a perspective view of the front floating barrel and the front sleeve according to the above preferred embodiment of the present invention.
Figure 3:
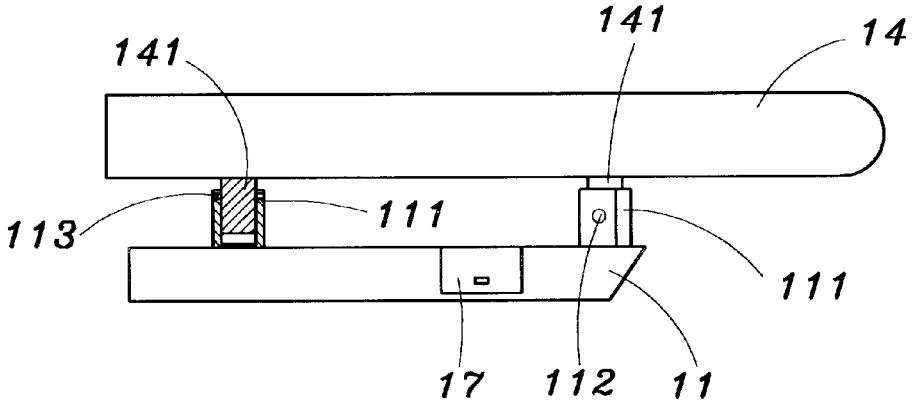
FIG. 3 is a partly sectional view of the assembly of the front floating barrel and the front sleeve according to the above preferred embodiment of the present invention.

The main body 10 comprises a front sleeve 11, a rear sleeve 12 and a support stand 13 passing through the front sleeve 11 and the rear sleeve 12 (as shown in FIG. 1). As shown in FIG. 2 and FIG. 3, two hollow pentahedrons 111 are vertically raised from the top of the front sleeve 11 and positioned in the front and rear respectively with their openings facing upwards. A plurality of drain holes 112 is provided in appropriate positions around the hollow pentahedrons 111. A reversed T-shaped embed slot 113 (as shown in the enlarged illustration in FIG. 2) is provided on one side and near the top of the hollow pentahedron 111 for a front floating barrel 14 to be slid into the hollow pentahedron 111.

Figure 4:
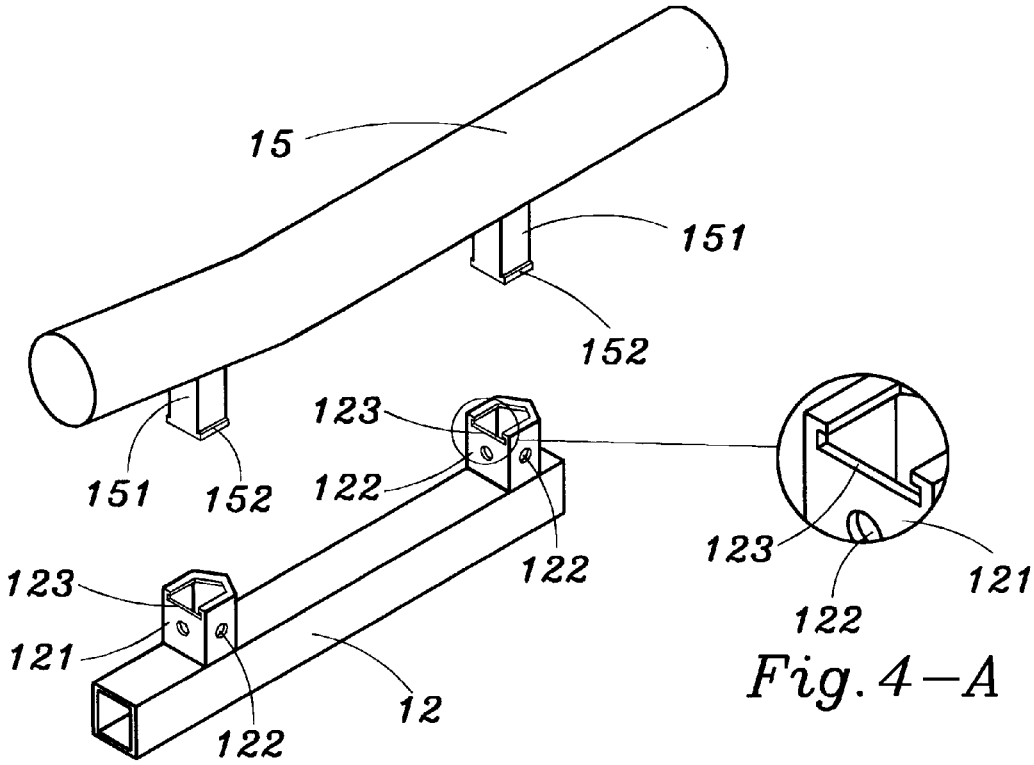
FIG. 4 is a perspective view of the rear floating barrel and the rear sleeve according to the above preferred embodiment of the present invention.

Moreover, two floating poles 141 are extended downwards from the bottom of the front floating barrel 14 in positions corresponding to the hollow pentahedrons 111 of the front sleeve 11, and an embed flange 142 is provided at the bottom of the floating pole 141 to be embedded into the embed slot of the hollow pentahedron 111. Likewise, two hollow pentahedrons 121 are vertically raised from the top of the rear sleeve 11 and positioned in the front and rear respectively with their openings facing upwards (as shown in FIG. 4). A plurality of drain holes 122 is provided in appropriate positions around the hollow pentahedrons 121.

A reversed T-shaped embed slot 123 (as shown in the enlarged illustration in FIG. 4) is provided on one side and near the top of the hollow pentahedron 121 for the rear floating barrel 15 to be slid into the hollow pentahedron 121. Two floating poles 151 are extended downwards from the bottom of the rear floating barrel 15 in positions corresponding to the hollow pentahedrons 121 of the rear sleeve 12, and an embed flange 152 is provided at the bottom of the floating pole 151 to be embedded into the embed slot of the hollow pentahedron 121.

Due to the floating poles 141 and 151, which are extended from the bottoms of the front floating barrel 14 and the rear floating barrel 15, sliding up and down inside the hollow pentahedrons 111 of the front sleeve 11 and the hollow pentahedrons 121 of the rear sleeve 12, the main body 10 is able to float on the water by the floating force of both the front and rear floating barrels, instead of sinking in the water.

Figure 7:
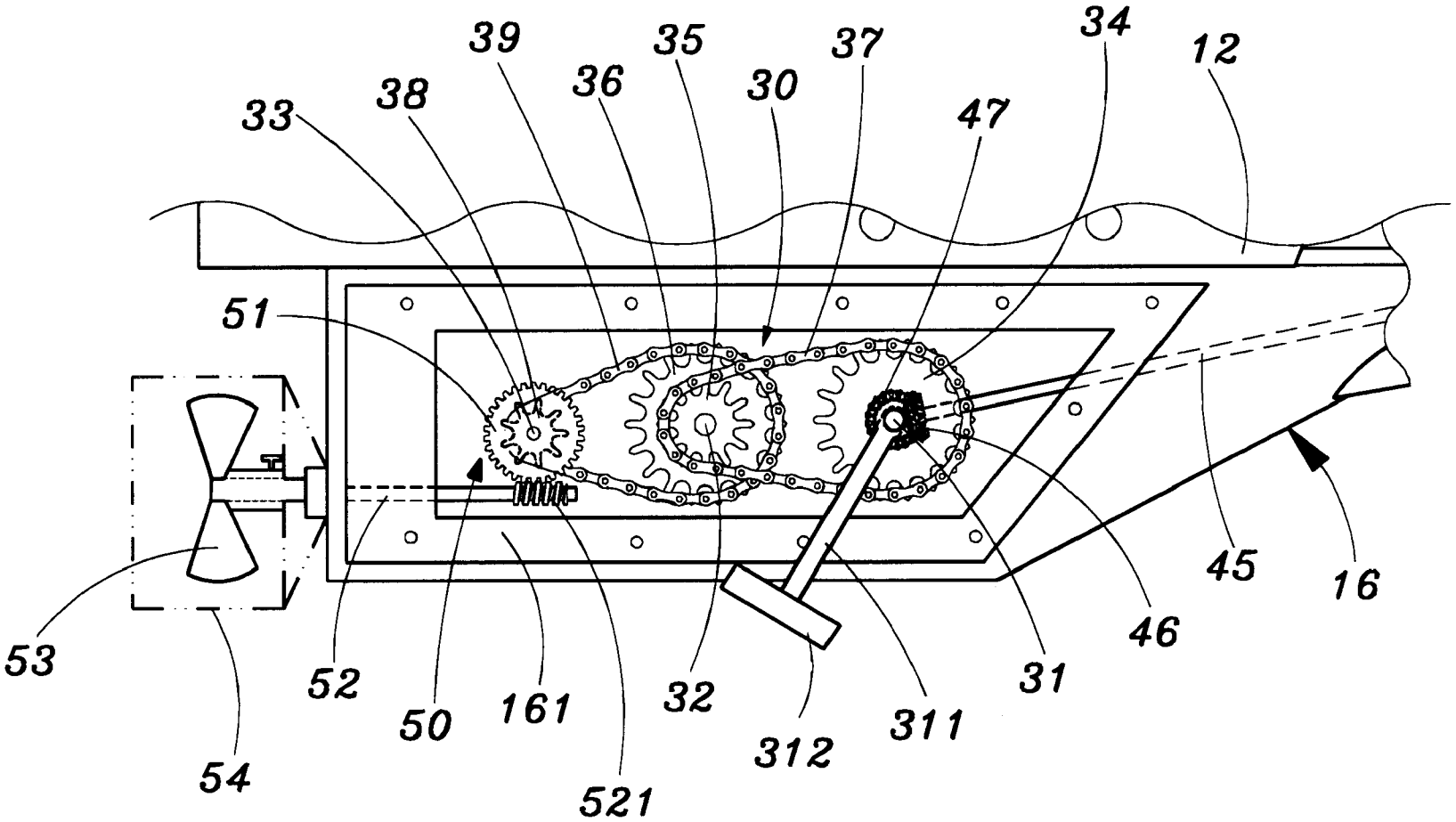
FIG. 7 is a front view of the rear drive and power output device placed inside the hollow casing according to the above preferred embodiment of the present invention.

Furthermore, as shown in FIG. 7, a hollow casing 16 is provided and affixed underneath the rear sleeve 12 for housing the rear drive speed variation device 30 and the power output device 50. An opening 161 is provided on one side of the hollow casing 16 for people to assemble or disassemble the components inside the hollow casing 16. A cover 162 is affixed by screws on the opening 161.

The front drive 20 comprises a T-shaped joint pipe 21 firmly affixed on the main body 10, a first mandrel 22 passing through the two openings of the traverse pipe of the T-shaped joint pipe, and cranks 23 affixed on both ends of the first mandrel 22 (as shown in FIG. 1). Moreover, a handle 23 is provided on the other end of each crank 23 for users to hold so that they can use their hands to rotate the handles 231 and drive the crank 23 in order to rotate the first mandrel 22.

Figure 6:
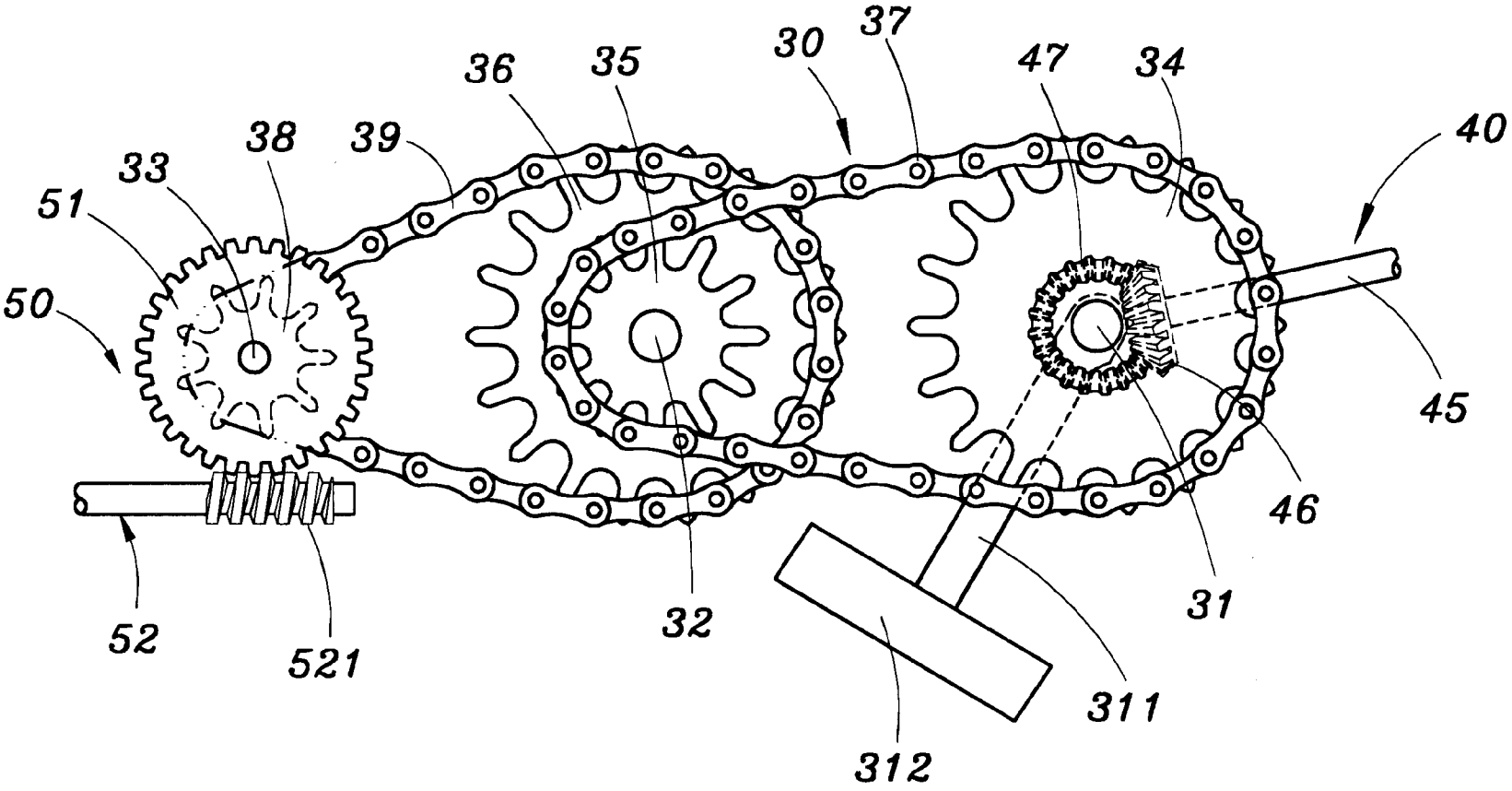
FIG. 6 is an enlarged view of the rear drive according to the above preferred embodiment of the present invention.

As shown in FIG. 6, the rear drive speed variation device 30 comprises a second mandrel 31, a third mandrel 32 and a fourth mandrel 33 mounted in the appropriate positions inside the hollow casing 16, a set of a first driving chain wheel 34, a first driven chain wheel 35 and a second driving chain wheel 36 respectively mounted on the third mandrel 32, a chain 37 mounted between the first driving chain wheel 34 and the first driven chain wheel 35, a second driven wheel 38 mounted on the fourth shaft 33 and a chain 39 mounted between the second driving chain wheel 36 and the second driven chain wheel 38. In which, both ends of the second mandrel 31 are extended out of the hollow casing 16 and the cover 162 respectively. A paddle 312 is provided on the other end of each crank 311 for users to step on, so that the users can rotate the second mandrel 31 by stepping on the paddle with their feet.

Figure 8:
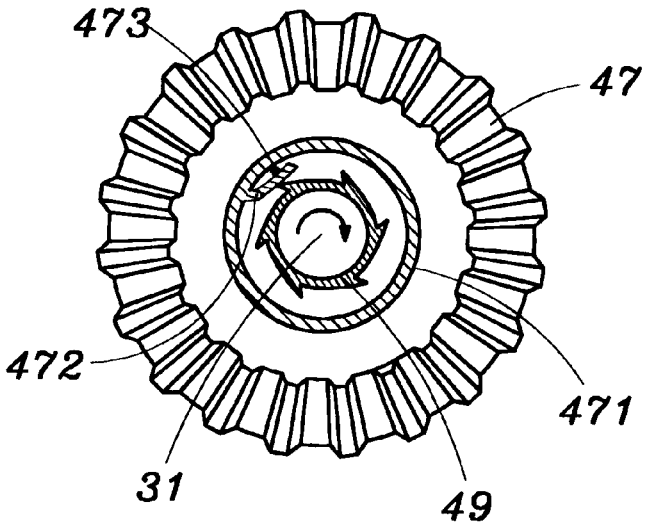
FIG. 8 is a view of the driven bevel gear with a ratchet according to the above preferred embodiment of the present invention.
Figure 9:
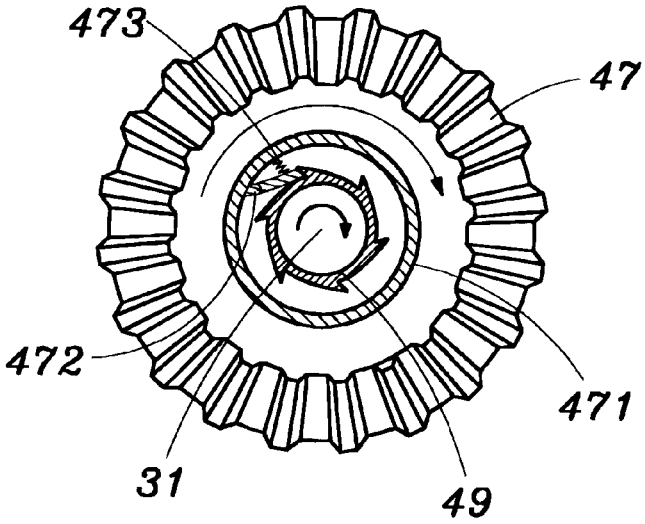
FIG. 9 is another view of the driven bevel gear with a ratchet according to the above preferred embodiment of the present invention.
Figure 10:
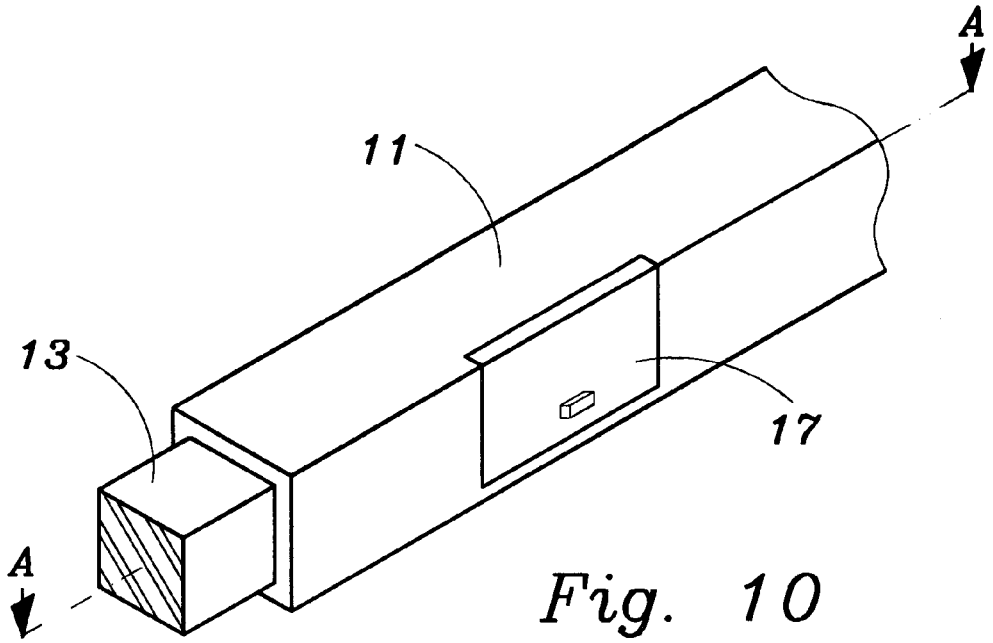
FIG. 10 is a perspective view of the usage of the cover on the front sleeve according to the above preferred embodiment of the present invention.
Figure 11:
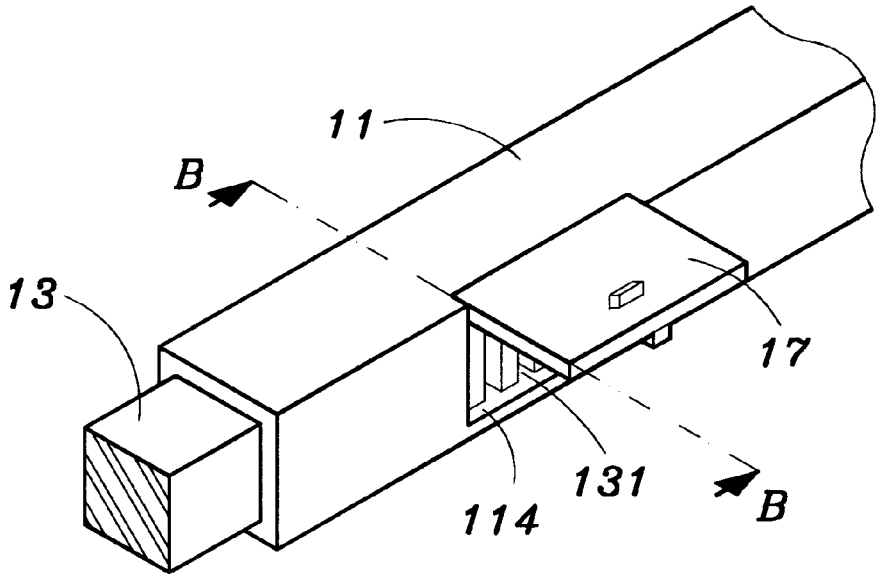
FIG. 11 is another perspective view of the usage of the cover on the front sleeve according to the above preferred embodiment of the present invention.
Figure 12:
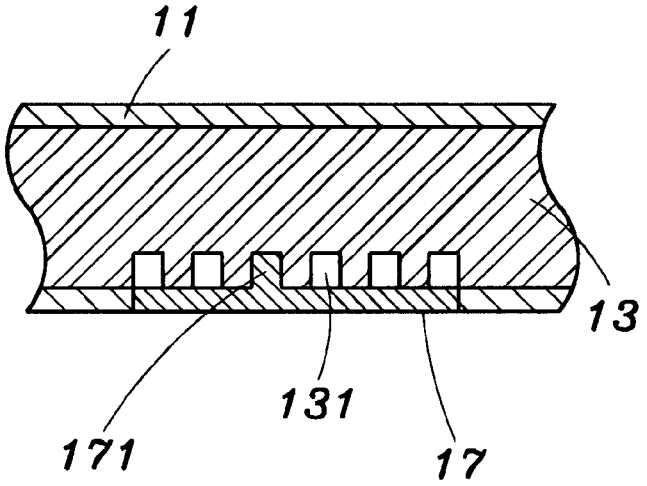
FIG. 12 is a sectional view of FIG. 10 at section A—A.
Figure 13:
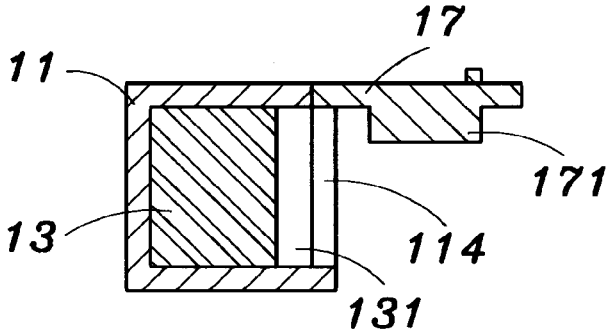
FIG. 13 is a sectional view of FIG. 11 at section B—B.
Figure 14:
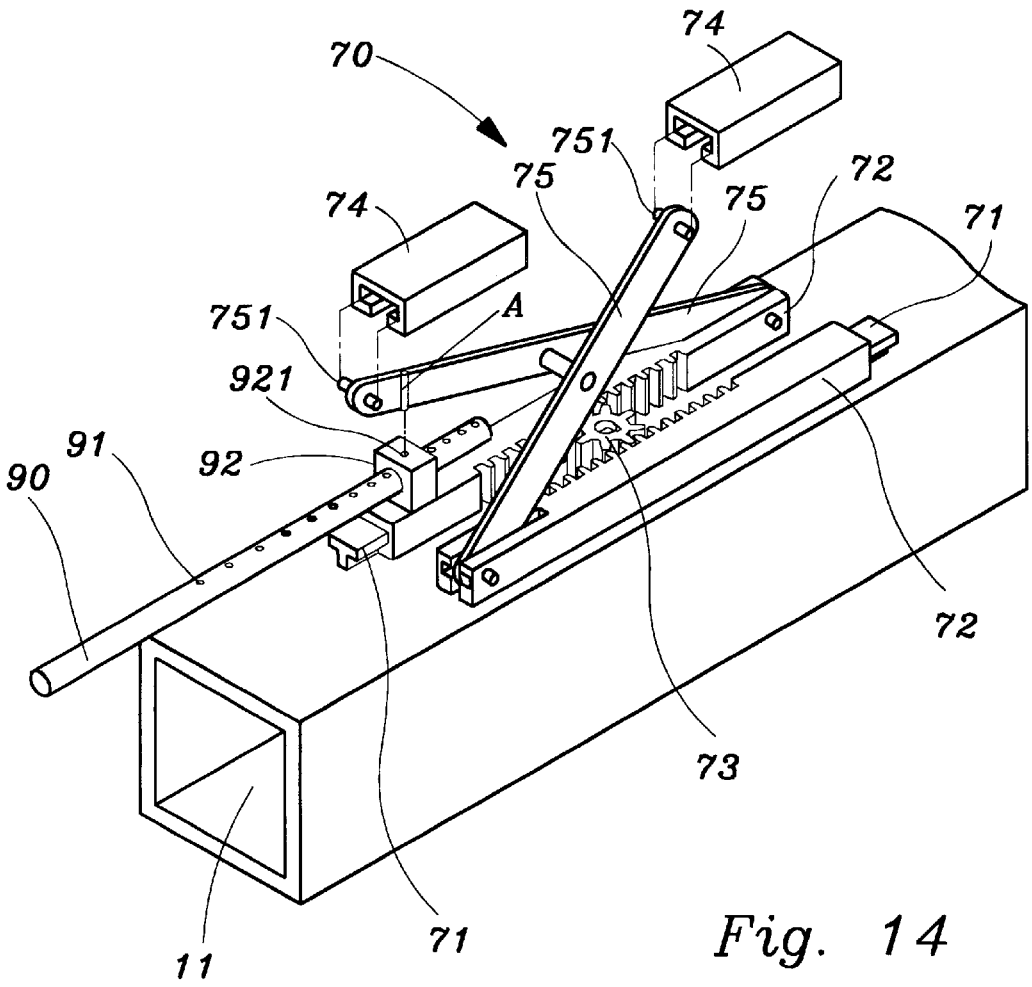
FIG. 14 is a perspective view of the front height-adjusting device according to the above preferred embodiment of the present invention.
Figure 15:
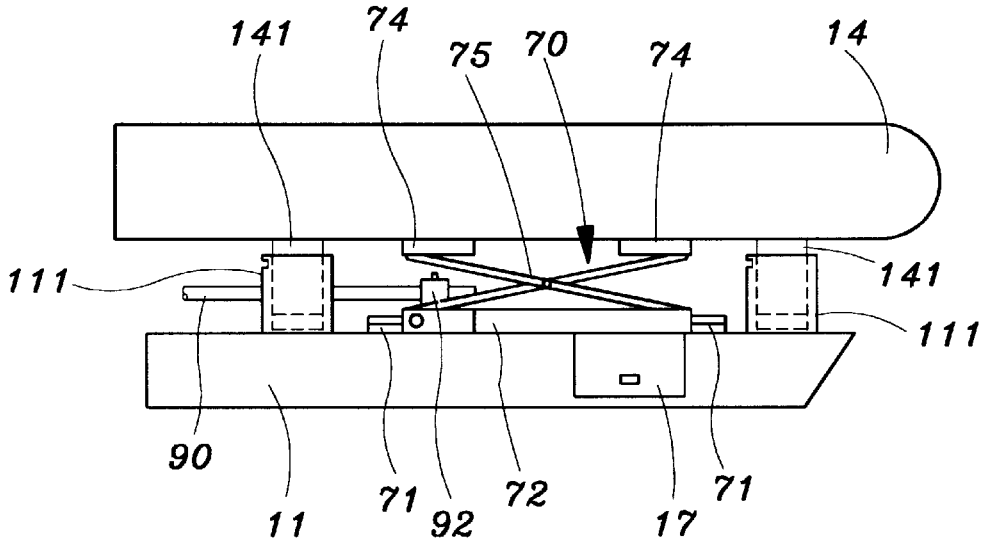
FIG. 15 is a front view of the height adjustment between the front floating barrel and the front sleeve according to the above preferred embodiment of the present invention.
Figure 16:
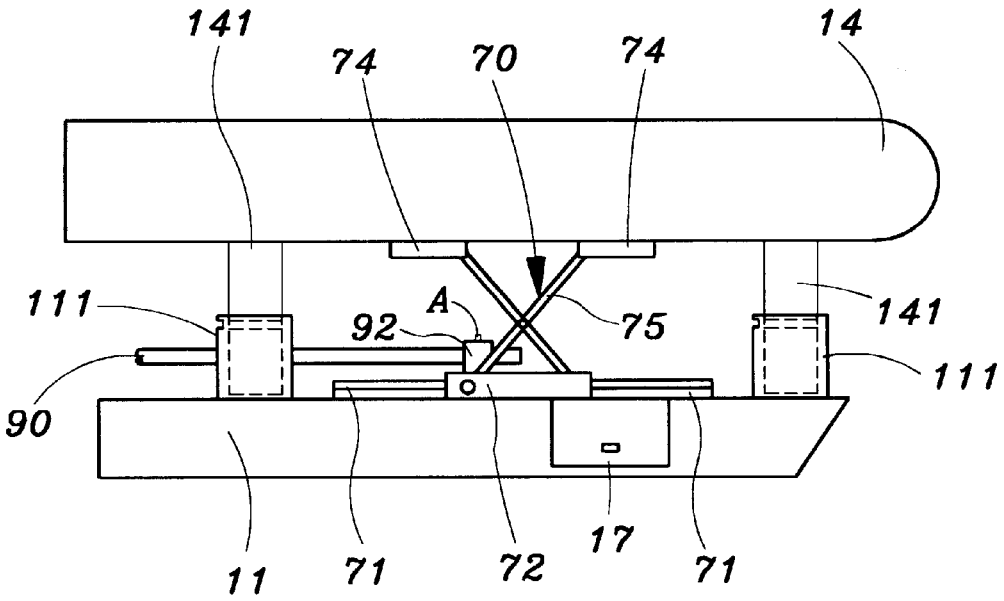
FIG. 16 is another front view of the height adjustment between the front floating barrel and the front sleeve according to the above preferred embodiment of the present invention.

Referring to FIG. 5 to FIG. 9, the power transmitting device 40 comprises driving bevel gear 41 mounted on the first mandrel 22, a two-stage first transmitting shaft 42 passing through the axial pipe of the T-shaped joint, a driven bevel gear 43 mounted on one end of the first transmitting shaft 42 and engaged with the driving bevel gear 41, a universal joint 44 mounted on the other end of the first transmitting shaft 42, a second transmitting shaft 45 mounted on one end of the universal joint 44 and penetrating into the hollow casing 16, a driving bevel gear 46 mounted on the other end of the second transmitting shaft 45, a driven bevel gear 47 rotating freely on the second mandrel 32 and engaged with the driving bevel gear 46, a joint sleeve 48 mounted on the first transmitting shaft 42, and a ratchet 49 rotating around the second mandrel 31. In which, a cylindrical ring 471 is mounted on the bevel gear in the appropriate position corresponding to the ratchet 49 (as shown in FIG. 8 and FIG. 9). A pawl 472 is mounted on the inner surface of the cylindrical ring 471. A pre-depressed spring is mounted between the pawl 472 and the inner surface of the ring 471.

Figure 5:
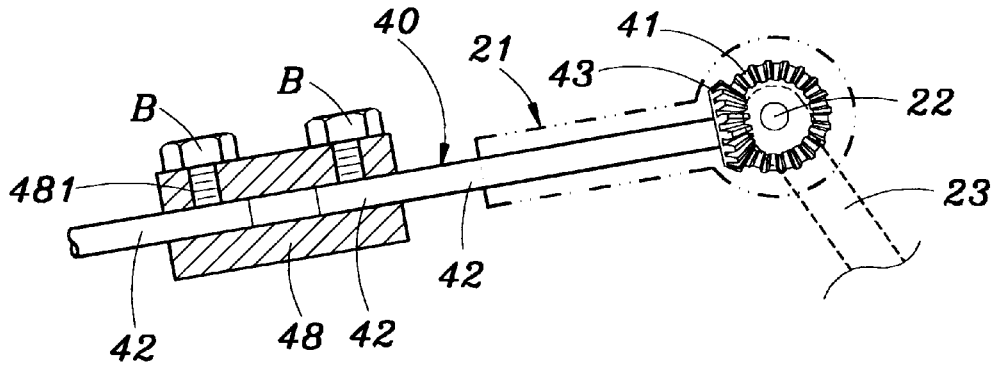
FIG. 5 is a front view of the front drive according to the above preferred embodiment of the present invention.

With such a structure of the power transmitting device 40, the user can not only transmit power from the front drive device 20 to the rear drive speed variation device 30, but also, due to provision of the ratchet 49, prevent power from being transmitted backwards from the rear drive speed variation device 30 when the user's hands stop rowing, causing automatic rotation of the crank 23 and handle 231, thus hitting the user and resulting in injury of the user. Moreover, two screw holes 481 are drilled in the appropriate positions along the axial direction on the joint sleeve 48 for bolts B to be driven in (as shown in FIG. 5), so that the first transmitting shaft 42 would have desired variable length by tightening or loosening the bolts B when the length of the first transmitting shaft 42 is adjusted.

Referring to FIG. 6 and FIG. 7, the power output device 50 comprises a worm gear 51 mounted on the fourth mandrel 33, an output shaft 52 mounted in the appropriate position of the hollow casing 16, wherein a worm 521 is mounted at one end of the output 52 and engaged with the worn gear 51, enabling the power on the fourth mandrel 33 to be transmitted to the output shaft 52. Moreover, the other end of the output shaft 52 are extended out of the hollow casing 16, and a propeller is mounted on the output shaft 52. Thus, the power transmitted from the front power device 20 or the rear drive speed variation device 30 can be converted by the power output device 50 into driving force and output for moving forward.

Referring to FIG. 1 to FIG. 9, when the preferred embodiment of present invention is placed in water, it will float in the water due to the buoyancy of the front floating barrel 14 and the rear floating barrel 15 instead of being sunk into the water, and the weight of each device will be able to keep its center of gravity in the water in a upright position. Even though when it bears the weight of a human body (minus buoyancy) or it is in operation, any swing to the left or to the right due to unstable center of gravity would not occur.

Therefore, when the user places one's hands on the handle 231 of the front drive 20 and feet on the paddle 312 of the rear drive 30, the user will be able to exert force on the handle 231 and paddle 312, driving the two cranks 23 and 311 and rotating the first mandrel 22 and the second mandrel 31.

At this moment, the first mandrel 22 will rotate the driving bevel gear 41 and the synchronously engaged driven bevel gear 43 so that the power of the first mandrel 22 can be transmitted from the first transmitting shaft 42 to the second transmitting shaft 45, enabling the driving bevel gear 46 of the second transmitting shaft 45 to drive the driven bevel gear 47 of the second mandrel 31, and the pawl 472 of the ring 471 to push ratchet 49 (as shown in FIG. 9), thus transmitting power to the second mandrel 31.

At this moment, the power generated by the hands and feet will be transmitted instantly onto the first driven chain wheel 35 of the third mandrel 32 through the transmission of the chain 37 (as shown in FIG. 6). Then, the second driving chain wheel 36, which rotates simultaneously with the first driven chain wheel 35 on the third mandrel 32, will drive the chain 39, rotating the second driven chain wheel 38 and the fourth mandrel 33. Then, the worm gear 51 on the fourth mandrel 33 will transmit the power from the front drive 20 and the rear drive 30 onto the propeller 53 through the engaged worm 52, rotating the propeller 53 and creating the power needed for moving forward.

Besides, as shown in FIG. 8 and FIG. 9, the user may choose to drive with either hands or feet to do the exercise according to one's own needs and physical condition. If the user chooses to drive with one's hands only, the direction of power transmission will be the same as the above. If the user chooses to drive with one's feet only, the power on the second mandrel 31 would drive the first driving chain wheel 34 only, not the driven bevel gear 47 because the ratchet 49 can not be engaged with the pawl 472 on the driven bevel gear 47 when the second mandrel 31 is rotating. Therefore, the driven bevel gear 47 would not rotate, but stay still (as illustrated by the arrows in FIG. 8). When the user chooses to drive with one's feet only, the feature that the driven bevel gear 47 transmits power in only one direction can effectively prevent power from transmitting backward to the first mandrel 22, and prevent the crank 23 and handle 231 from rotating automatically, resulting in any bodily injury of the user.

Moreover, the ratios of the number of teeth between the first driving chain wheel 34 and the first driven chain wheel 35, as well as between the second driving chain wheel 36 and the second driven chain wheel 38, of the rear drive speed variation device 30 may be appropriately chosen according to user's actual needs, e.g. the user may choose smaller ratios if one wants to save one's energy, so as to achieve the best results of the physical exercise by choosing the right ratios. The lengths of the cranks 23 and 312 of the front drive 20 and the rear drive 30 may also be made according to yours actual needs, so as to stretch your arms and legs to the best extent when you exert forces on the handle 231 of the front drive 20 and on the paddle 312 of the rear drive 30 respectively.

Furthermore, because the preferred embodiment of the present invention floats horizontally on the water surface, even those people, who are not able to swim or not good at swimming, can operate the device very easily to obtain the effect of physical exercise and fitness. In order to fit different body sizes of the users, the preferred embodiment of the present invention provides a plurality of vertical groove 131 on one side of the support stand 13 which is inserted into the front sleeve 11, as shown in FIG. 10 to FIG. 13.

An opening 114 is provided on the wall of the front sleeve 11 corresponding to the grooves 131. A cover 17 is hinged on the wall adjacent to the opening 113. A vertical protruded bar is provided at the appropriate position on the cover. Therefore, you may adjust and fix the length of the device according to your height by opening the cover 17, pushing in or pulling out the support stand 13 for a proper distance inside the front sleeve 11, then inserting the protruded bar 171 into the groove 131 on the support stand 13 when you use the preferred embodiment of the present invention. Moreover, as shown in FIG. 5, the joint sleeve 48 of the power transmission device 40 can be adjusted in accordance with the above-mentioned adjusted length of the front sleeve 11 by correspondingly adjusting with the bolts B.

Referring to FIG. 14 to FIG. 17, the preferred embodiment of the present invention further comprises a front height adjusting device 70 between the front sleeve 11 and the front floating barrel 14, and a rear height adjusting device 80 between the rear sleeve 12 and the rear floating barrel 15, wherein the front height adjusting device 70 comprises two parallel guiding rails 71 fixed on the top surface of the front sleeve 11, two racks 72 sliding on the guiding rails 71, a pinion 73 engaged between the two racks 72 and positioned on the top surface of the front sleeve 11, two T-shaped sliding slots 74 fixed on the bottom of the front floating barrel 14 and a set of connecting bars 75 between the T-shaped sliding slots 74 and racks 72.

In which, each of the upper two free ends of the connecting bars has a sliding stick 751 which can slide inside the T-shaped sliding slots 74. The lower two free ends of the connecting bars 75 are connected to the end of the two racks 72 respectively. Therefore, by sliding one of the racks 72 of the front height adjusting device 70, you can rotate the pinion 73 and in turn slide the other rack 72 in an opposite direction. At the meantime, the connecting bars 75 would simultaneously move the front floating barrel 14 up or down, achieving the purpose of adjusting the distance between the front sleeve 11 and the front floating barrel 14.

Figure 17:
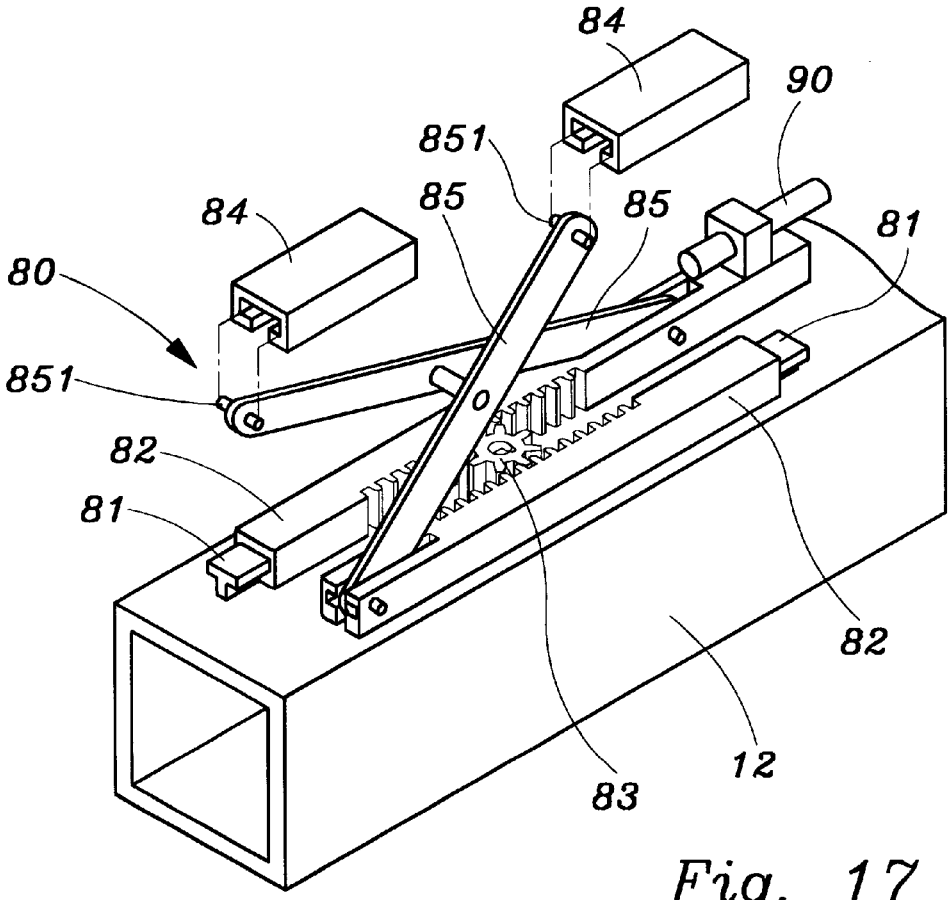
FIG. 17 is a perspective view of the rear height-adjusting device according to the above preferred embodiment of the present invention.

The structure of the rear height adjusting device 80 is the same as the front height adjusting device 70 (as shown in FIG. 17). It comprises two parallel guiding rails 81 affixed on the top surface of the rear sleeve 81, two racks 82 sliding on the guiding rails 81, a pinion 83 engaged between the two racks 82 and positioned on the top surface of the rear sleeve 12, two T-shaped sliding slots 84 fixed on the bottom of the rear floating barrel 15, and a set of connecting bars 85 between the T-shaped sliding slots 84 and racks 82. In which, each of the upper two free ends of the connecting bars has a sliding stick 851 which can slide inside the T-shaped sliding slots 84, and the lower two free ends of the connecting bars 85 are connected to the end of the two racks 82 respectively.

The movement of the rear height-adjusting device 80 is the same as the front height-adjusting device 70, moreover, the rack 82 of the rear height-adjusting device and rack 72 of the front height-adjusting device 70 are connected by a connecting pole 90. There is a plurality of positioning holes 91 on the connecting pole 91 near the rack 72. A fixing block 92 is mounted at the appropriate position on the rack 72 for the connecting pole 92 to penetrate through it. On the top of the fixing block 92, there is a pinhole 921 for a pin A to insert, the connecting pole 90 can be adjusted according to the distance between the front sleeve 11 and the rear sleeve 12. By moving the connecting 92, you can simultaneously move the racks 72 and 82 which are mounted respectively on the front sleeve 11 and the rear sleeve 12.

Referring to FIG. 1, a flow build-up barrel 54 can be mounted around the propeller on the output shaft 52 of the power output device 50. Because the insider wall of the barrel is surrounding the outer edge of the propeller 53, the water flow stirred up by the propeller 53 is discharged through the opening 541 of the flow build-up barrel 54 to minimize the advancing power loss of the propeller 53.

What is claimed is:

1. A manually driven fitness device, comprising a main body, which comprises a front sleeve, a rear sleeve and a support stand passing through said front sleeve and said rear sleeve; wherein two hollow pentahedrons are vertically raised from a top of said front sleeve and positioned in a front and rear respectively with openings facing upwards thereof, a plurality of drain holes being provided in appropriate positions around said hollow pentahedrons, a reversed T-shaped embed slot being provided on one side and near a top of said hollow pentahedron for a front floating barrel to be slid into said hollow pentahedron, two floating poles being extended downwards from a bottom of said front floating barrel in positions corresponding to said hollow pentahedrons of the said front sleeve, a flange being provided at a bottom of the said floating pole to be embedded into an embed slot of said hollow pentahedron; two hollow pentahedrons being vertically raised from a top of the said rear sleeve and positioned in a front and rear respectively with openings facing upwards thereof, a plurality of drain holes being provided in appropriate positions around said hollow pentahedrons, a reversed T-shaped embed slot being provided on one side and near a top of said hollow pentahedron for a rear floating barrel to be slid into said hollow pentahedron, two floating poles being extended downwards from a bottom of the said rear floating barrel in positions corresponding to said hollow pentahedrons of said rear sleeve, a flange being provided at a bottom of said floating pole to be embedded into an embed slot of said hollow pentahedron; a hollow casing being provided and affixed underneath said rear sleeve for housing a rear drive speed variation device and a power output device, an opening being provided on one side of said hollow casing for people to assemble or disassemble components inside said hollow casing, a cover being affixed by screws on said opening;

a front drive, which comprises a T-shaped joint pipe firmly affixed on said main body, a first mandrel passing through two openings of a traverse pipe of said T-shaped joint pipe, and cranks affixed on both ends of said first mandrel, wherein a handle is provided on the other end of each of said cranks for users to hold;

a rear drive speed variation device, which comprises a second mandrel, a third mandrel and a fourth mandrel mounted in appropriate positions inside said hollow casing, a set of a first driving chain wheel, a first driven chain wheel and a second driving chain wheel respectively mounted on said third mandrel, a chain mounted between said first driving chain wheel and said first driven chain wheel, a second driven wheel mounted on said fourth mandrel, and a chain mounted between said second driving chain wheel and said second driven chain wheel, wherein both ends of said second mandrel are extended out of said hollow casing and said cover respectively, and each of said ends is mounted with a crank while a paddle is provided on the other end of each of said cranks for said user to step on;

a power transmitting device, which comprises a driving bevel gear mounted on said first mandrel, a two-stage first transmitting shaft passing through an axial pipe of a T-shaped joint, a driven bevel gear mounted on one end of the said first transmitting shaft and engaged with said driving bevel gear, a universal joint mounted on the other end of said first transmitting shaft, a second transmitting shaft mounted on one end of said universal joint and penetrating into said hollow casing, a driving bevel gear mounted on the other end of said second transmitting shaft, a driven bevel gear rotating freely on said second mandrel and engaged with said driving bevel gear, a joint sleeve mounted on said first transmitting shaft, a ratchet rotating around said second mandrel, in which a cylindrical ring is mounted on a bevel gear in an appropriate position corresponding to said ratchet, a pawl is mounted on an inner surface of said cylindrical ring, and a pre-depressed spring is mounted between said pawl and an inner surface of said cylindrical ring, moreover, two screw holes are drilled in appropriate positions along an axial direction on said joint sleeve for bolts to be driven in; and a power output device, which comprises a worm gear mounted on said fourth mandrel, an output shaft mounted in an appropriate position of said hollow casing; in which a worm is mounted at one end of said output shaft and engaged with aid worm gear, enabling power on said fourth mandrel to be transmitted to said output shaft, moreover, the other end of said output shaft is extended out of said hollow casing, and a propeller is mounted on said output shaft, wherein a flow build-up barrel is mounted around said propeller on said output shaft.

2. A manually driven fitness said device, as defined in claim 1, further comprising a front height adjusting device provided between said front sleeve and said front floating barrel, and a rear height adjusting device provided between said rear sleeve and said rear floating barrel, wherein said front height adjusting device comprises two parallel guiding rails affixed on a top surface of said front sleeve, two racks sliding on said guiding rails, a pinion engaged between said two racks and positioned on a top surface of said front sleeve, two T-shaped sliding slots affixed on a bottom of said front floating barrel, and a set of connecting bars provided between said T-shaped sliding slots and racks; in which each of upper two free ends of said connecting bars has a sliding stick which is able to slide inside said T-shaped sliding slots, and lower two free ends of said connecting bars are connected to ends of said two racks respectively; wherein structure of said rear height adjusting device is identical to said front height adjusting device, which comprises two parallel guiding rails affixed on a top surface of said rear sleeve, two racks sliding on the said guiding rails, a pinion engaged between said two racks and positioned on a top surface of the said rear sleeve, two T-shaped sliding slots affixed on a bottom of said rear floating barrel and a set of connecting bars provided between said T-shaped sliding slots and said racks, in which each of upper two free ends of connecting bars has a sliding stick which is able to slide inside said T-shaped sliding slots, and lower two free ends of said connecting bars are connected to ends of said two racks respectively; so that the movement of said rear height-adjusting device is same as said front height-adjusting device, moreover said rack of said rear height-adjusting device and said rack of said front height-adjusting device are connected by a connecting pole, wherein a plurality of positioning holes is provided on said connecting pole near said rack, a fixing block is mounted in appropriate position on said rack for said connecting pole to penetrate threrethrough, and a pinhole is provided on a top of the said fixing block for a pin A to insert therethrough.

3. A manually driven fitness device, as defined in claim 1, wherein an opening is provided on a wall of said front sleeve corresponding to said grooves, a cover is hinged on a wall adjacent to said opening, and a vertical protruded bar is provided in appropriate position on said cover.

4. A manually driven fitness device, as defined in claim 2, wherein an opening is provided on a wall of the said front sleeve corresponding to said grooves, a cover is hinged on a wall adjacent to the said opening, and a vertical protruded bar is provided in appropriate position on said cover.

* * * * *